United States Patent [19]

Keller

[11] 4,408,675

[45] Oct. 11, 1983

[54] DUAL OUTLET ENGINE EXHAUST SYSTEM

[75] Inventor: Robert C. Keller, Troy, Mich.

[73] Assignee: General Motors Corporation, Detroit, Mich.

[21] Appl. No.: 266,171

[22] Filed: May 22, 1981

[51] Int. Cl.[3] ..... F01N 7/04

[52] U.S. Cl. ..... 180/296; 180/89.2; 180/309; 181/240

[58] Field of Search ..... 180/296, 309, 89.2; 181/239, 238, 240

[56] References Cited

U.S. PATENT DOCUMENTS

| | | | |
|---|---|---|---|
| 1,280,386 | 10/1918 | Buehner | 181/238 |
| 1,708,002 | 4/1929 | Warhus . | |
| 2,841,348 | 7/1958 | Stahlhuth | 180/89.2 |
| 2,940,249 | 6/1960 | Gospodar | 60/32 |
| 3,070,187 | 12/1962 | Deremer | 181/238 |
| 3,189,122 | 6/1965 | Martin | 181/56 |
| 3,685,615 | 8/1972 | Rutt | 181/239 |

FOREIGN PATENT DOCUMENTS

| | | | |
|---|---|---|---|
| 2910370 | 10/1980 | Fed. Rep. of Germany | 181/240 |

*Primary Examiner*—David M. Mitchell
*Attorney, Agent, or Firm*—R. L. Phillips

[57] ABSTRACT

A dual outlet engine exhaust system having a pair of resonators which are joined as a rigid assembly by a resonator manifold which also maintains divided exhaust gas flow to the resonators.

1 Claim, 4 Drawing Figures

DUAL OUTLET ENGINE EXHAUST SYSTEM

This invention relates to a dual outlet engine exhaust system and more particularly to such an arrangement wherein a pair of resonators are employed.

In vehicles having a dual outlet engine exhaust system employing a pair of resonators, it is common practice to have the resonators physically separated and employ extensive piping to produce a distinct beating exhaust sound which is desired by a substantial segment of car-buyers. Such systems typically require considerable underbody space and numerous mounting points as well as long tail pipes extending from the resonators to the rear of the vehicle.

The dual outlet engine exhaust system according to the present invention is a very simple, easy to install, compact arrangement with few attaching points which functions to create the desired distinct beating exhaust sound. In the preferred embodiment, there is provided a single exhaust pipe which extends from the engine and to which a pair of branch pipes are connected. Each of the two resonators has a separate inlet and an outlet and there is provided a separate tail pipe connected to each such resonator outlet. To then complete the system, there is provided a resonator manifold including a gas separator for both rigidly mechanically interconnecting the resonators while separately gaseously connecting their inlets to the respective branch pipes. The resonators are thus formed as a rigid compact assembly which can be simply and easily installed with only two mounting devices in the vehicle. Moreover, the exhaust gases are divided by such branch pipes with the divided exhaust gases maintained separate from each other by the gas separator while passing through the resonator manifold to the resonators and thence out through the tail pipes to create the distinct beating exhaust sound.

These and other objects and advantages of the present invention will be more apparent from the following description and drawing in which.

Figure 1:
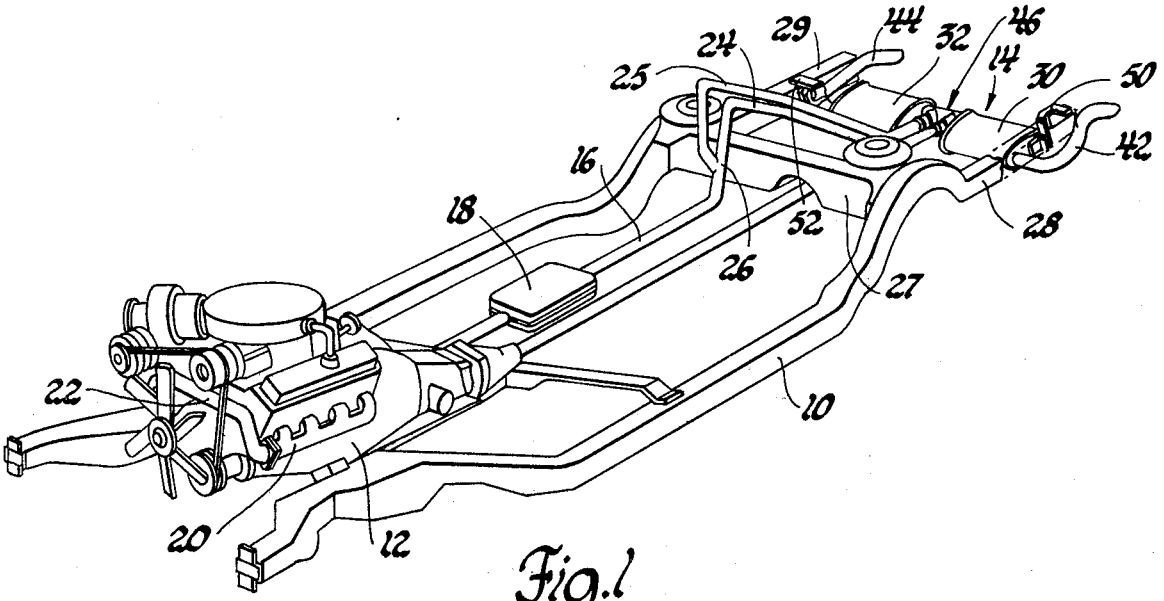
FIG. 1 is a perspective view of the presently preferred embodiment of the dual outlet exhaust system according to the present invention shown installed in a vehicle (only those parts of the vehicle believed helpful on understanding the invention being shown).

Referring to FIG. 1, there is shown a vehicle frame 10 with a V-8 internal combustion engine 12 mounted thereon to which is adapted the presently preferred embodiment of the dual outlet engine exhaust system according to the present invention. The dual outlet engine exhaust system which is generally designated as 14 comprises an exhaust pipe 16 extending from and connected through a catalytic converter 18 to the exhaust manifolds 20 of the engine 12, the exhaust manifolds being interconnected by a front crossover pipe 22 (only the lefthand side exhaust manifold being shown and the righthand side exhaust manifold which is not shown being directly connected to the exhaust pipe 16). A pair of branch pipes 24 and 25 are connected to the exhaust pipe 16 at a Y-joint 26 just ahead of the frame's rear cross member 27 and are formed so as to extend up over the rear cross member and then rearwardly longitudinally of the vehicle in close parallel relationship centrally of the frame's side rails 28 and 29.

Figure 2:
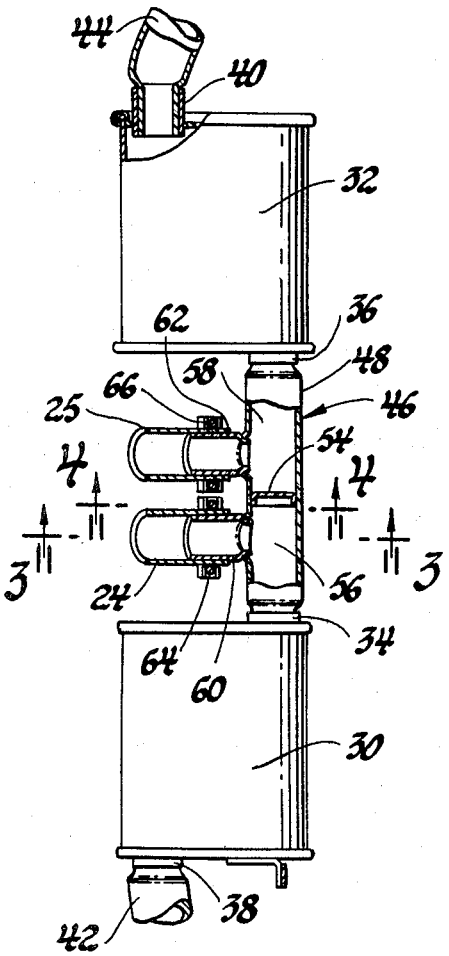
FIG. 2 is an enlarged plan view of the dual resonator assembly of the dual outlet exhaust system shown in FIG. 1.
Figure 3:
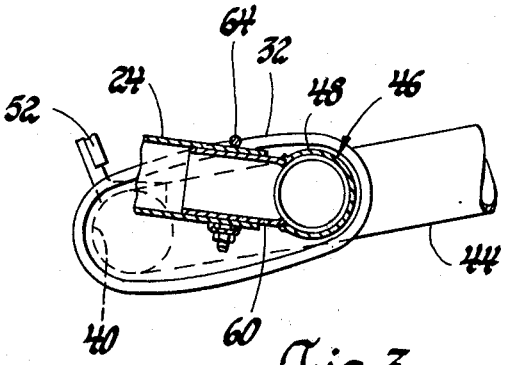
FIG. 3 is a vertical sectional view taken along the line 3—3 in FIG. 2.
Figure 4:
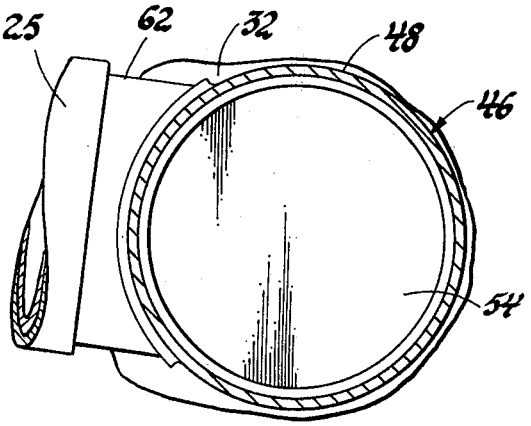
FIG. 4 is an enlarged vertical sectional view taken along the line 4—4 in FIG. 2.

A pair of end-to-end arranged resonators 30 and 32 are mounted transversely on and between the frame side rails 28 and 29 behind the frame's rear cross member 27. The resonators 30 and 32 each have an inlet 34, 36 and an outlet 38, 40 respectively (see FIG. 2) and to the respective outlets there are connected separate tail pipes 42 and 44 which because of the resonators' extreme rear location need extend only a short distance to the rear of the vehicle (see FIG. 1). As best shown in FIGS. 2, 3 and 4, there is provided a common or dual resonator manifold 46 comprising a pipe 48 which is welded at its opposite ends to the resonators' inlets 34 and 36 to thus rigidly directly mechanically interconnect the two resonators 30 and 32. As a result, both resonators 30 and 32 may be simply and easily mounted at their outlet ends on the frame side rails 28 and 29 by the two simple mounting hangers 50 and 52 shown in FIG. 1. The resonator manifold pipe 48 does not, however, gaseously interconnect the resonator's inlets 34 and 36 and instead such is positively prevented by a gas separator plate 54 which is press-fitted in the pipe 48 at a point midway between its ends (see FIGS. 2 and 4) so as to divide the resonator manifold into two separate branches 56 and 58 which separately communicate with the respective resonator inlets 34 and 36. The thus separate resonator manifold branches 56 and 58 to the respective resonator inlets 34 and 36 are then separately connected to the respective exhaust branch pipes 24 and 25 through resonator manifold short inlet pipes 60 and 62 which are welded to the resonator manifold pipe 48 at the respective manifold branches adjacent to and on opposite sides of the gas separator 54. The exhaust branch pipes 24 and 25 are detachably connected to the resonator manifold inlet pipes 60 and 62 by pipe clamps 64 and 66 respectively.

The dual resonator manifold 46 including the gas separator 54 thus serves to rigidly, directly mechanically interconnect the resonators 30 and 32 in a compact arrangement for easy and simple transverse mounting in the vehicle with the two mounts 50 and 52 while also separately gaseously connecting the resonator inlets 34 and 36 to the respective exhaust branch pipes 24 and 25. With the exhaust gases divided by the exhaust branch pipes 24 and 25 thereafter maintained separate from each other by the gas separator plate 54 while passing through the resonators 30 and 32 and thence out through the separate short tail pipes 42 and 44, the distinctive beating exhaust sound desired is maintained without extensive piping.

The above described preferred embodiment is illustrative of the invention which may be modified within the scope of the appended claims.

The embodiments of the invention in which an exclusive property or privilege is claimed are defined as follows:

1. In a dual outlet engine exhaust system for an internal combustion engine mounted in a vehicle, an exhaust pipe extending from the engine, a pair of branch pipes connected to said exhaust pipe and extending rearwardly longitudinally and centrally of the vehicle in substantially parallel relationship, a pair of resonators each having an inlet and an outlet, said resonators being arranged end-to-end at their inlet end and transverse of the vehicle, mounting means mounting the outlet end of each resonator on the vehicle, a tail pipe connected to each outlet, and resonator manifold means including a gas separator located directly between the inlet ends of said resonators for both rigidly mechanically interconnecting said resonators while separately gaseously directly connecting their inlets to the respective branch pipes whereby said resonators form a rigid assembly and together with said tail pipes are mounted directly on the vehicle by only said mounting means at the outlet ends of said resonators and whereby the exhaust gases are divided by said branch pipes with such divided exhaust gases thereafter maintained separate from each other by said gas separator while passing through said resonators and thence separately out through said tail pipes to create a distinct exhaust sound.

* * * * *